US005479846A

United States Patent [19]

Trapp

[11] Patent Number: 5,479,846

[45] Date of Patent: Jan. 2, 1996

[54] PISTON MACHINE ABLE TO BE USED AS A COMPRESSOR OR MOTOR

[75] Inventor: Claude Trapp, Rueil Malmaison, France

[73] Assignee: Seref, France

[21] Appl. No.: 244,258

[22] PCT Filed: Nov. 20, 1992

[86] PCT No.: PCT/FR92/01077

§ 371 Date: May 20, 1994

§ 102(e) Date: May 20, 1994

[87] PCT Pub. No.: WO93/10353

PCT Pub. Date: May 27, 1993

[30] Foreign Application Priority Data

Nov. 22, 1991 [FR] France ..... 91 14385

[51] Int. Cl.[6] ..... F01B 15/00

[52] U.S. Cl. ..... 92/66; 92/117 R; 92/140; 92/187

[58] Field of Search ..... 92/57, 117 R, 92/117 A, 118, 66, 129, 140, 187

[56] References Cited

U.S. PATENT DOCUMENTS

| | | | |
|---|---|---|---|
| 2,146,133 | 2/1939 | Tweedale | 403/62 |
| 3,168,014 | 2/1965 | Aslaw | 92/118 |
| 3,314,336 | 4/1967 | Jorgji | 92/118 |
| 3,414,302 | 12/1968 | Priest . | |
| 4,231,672 | 11/1980 | Blanpain et al. | 403/62 |
| 4,443,163 | 4/1984 | Gaither | 92/117 A |
| 4,511,276 | 4/1985 | Doutt | 403/77 |

FOREIGN PATENT DOCUMENTS

| | | | |
|---|---|---|---|
| 14206 | of 1852 | United Kingdom | 92/66 |
| 636247 | 3/1946 | United Kingdom | 92/129 |
| 1387356 | 3/1975 | United Kingdom | 92/118 |

*Primary Examiner*—Thomas E. Denion
*Attorney, Agent, or Firm*—William A. Drucker

[57] ABSTRACT

The compressor includes a cylindrical housing (1), in the bore of which moves a piston (3) whose periphery is adjusted with little play in the cylinder (1). The end (5) of the piston (3) includes a gas inlet (6) and supports two spherical joints (7) as well as connecting rods (8,8') which are symmetrical in relation to the axis of the piston (3). The connecting rods (8,8') pass with play through a transverse wall (11) of the housing (1) and are driven by a mechanical member (13), which includes a mobile component (14) having a rectilinear reciprocating movement, and by a compensator (15). The connecting rods (8,8') are connected to the compensator (15) by means of ball joints (16, 16') and the compensator (15) is connected by a ball sorbet joint (17) to the mobile component (14).

8 Claims, 2 Drawing Sheets

PISTON MACHINE ABLE TO BE USED AS A COMPRESSOR OR MOTOR

The invention concerns machines with pairings of pistons and cylinders intended to embody a exchange of energy between an under pressure fluid and a mechanical member and more particularly to embody an air or any other gas compressor without nevertheless excluding the embodiment of a motor activated by the energy of a generally gaseous fluid.

Machines with pistons connected to mechanical energy members most frequently use the conventional connecting rod/crank system or sometimes a plate which oscillates around an oblique crank rotating around an axis parallel to the piston/cylinder pairing. There also exist slide or cam systems. All these systems introduce transverse forces, that is radial on the pistons relatively to their axis, which constitutes a friction factor with wear and creates dust. A rectilinear guiding cancels the transverse forces between the piston and the cylinder, but it requires lubrication which is a source of pollution and renders the unit heavy with a large spatial requirement.

The method is known on how to cancel the obliquity of a connecting rod relatively to the piston and the corresponding forces by using an oscillating cylinder. However, this creates transverse inertia forces due to its oscillation which are the source of the same drawbacks as mentioned above.

The aim of the invention is to avoid any systematic friction between the cylinder and the piston so as to render minimal the wear of these elements and enable them to function for a long period of time, especially for non-lubricated machines without any gasket between the piston and the cylinder and thus avoid creating pollution by oil or particles introduced by the wear of these elements.

For example, this embodiment for gas compression, even at extremely high pressures, is possible by accurately adjusting the surfaces opposite the cylinder and piston and for a significant length of the opposite parts of these two elements.

For example, with a radial play of 1 μm and a piston working length of 40 mm, it is possible to reduce the leak of a gas along this play to a value of less than 10% of the pumped flow.

So as to embody a piston machine providing these advantages, it is necessary to obtain a movement of the piston in the cylinder which is rectilinear within the limits of this extremely slight play without any systematic radial force. Thus, the piston shall be connected to a mechanical member which comprises a mobile element driven from the same alternative rectilinear movement and linked to the piston or even to the cylinder if the latter is mobile. In fact, any oblique linking, such as a connecting rod linked to a crank, creates under the force of the piston a radial component reaction on the latter.

There are various mechanical systems where an element is driven by an alternative rectilinear or almost rectilinear movement.

One of the earliest systems is WATT rodding, an example of this being shown on FIGS. 3 and 4 to be described subsequently.

Another known system is a gearing known as LA HIRE and constituted by a fixed ring internally toothed with a halfsized satellite gear and for which a point on the original diameter describes a straight line which passes through the centre of the ring.

So as to drive an elongated piston and with an extremely slight play relatively to a cylinder, it is possible to connect either of these two elements to a part driven by a movement which is rectilinear within the limits of this play.

If, however, the link is rigid, it is necessary to either align the mechanical member with a positioning tolerance better than the piston/cylinder play, which in practice cannot be achieved when this play is several μm, all the more so when the expansions and deformations on functioning aggravate the problem, or to allow the mechanical member to have transverse positioning freedom but its weight is then added to that of the driven element, thus resulting is producing radial forces due to heaviness or vibrations, which creates rubbings between the piston and the cylinder.

So as to resolve this problem, the invention, within alignment and average precision transverse mechanical positioning limits, frees the element driven from the rectilinear movement element borne by the mechanical member. It is possible to fix the transverse positioning limits to several 1/10ths of a mm and thus permit a transverse clearance of the same value between the driven element and the part of the mechanical member to which it is connected without the radial component of the forces of the mobile element becoming harmful.

The invention is therefore first of all characterized by the use of a spherical plain bearing or equivalent joint having two degrees of angular freedom between one of the elements of a piston/cylinder pairing and the rectilinear movement part of a mechanical member to which it is connected. This use makes it possible to align this member with the piston/cylinder pairing without creating any oblique force on the element connected to it. Instead of a ball type joint, it is possible to use a Cardan joint with two crossed axes.

This joint is preferably used with each of two elements of the pairing, one with the rectilinear movement part and the other with the fixed part of the machine.

Secondly, the invention is characterized also either by a connecting rod inserted between said joint and the rectilinear movement part, or by a joint which comprises two degrees of freedom in the direction of a movement perpendicular to the movement, that is in the direction traverse to the forces. These transverse movements may be ensured by a flat seating of the joint which presses on a transverse plate fitted on the corresponding element, or even by balls inserted between linear cooperating guiding surfaces perpendicular to the alternative movement. The transverse movements are preferably limited to a value slightly lower that the precision of the positioning of the mechanical member.

The use of ball type joints according to the invention makes it possible to have inside a large diameter piston a cylindrical mock passage, that is closed at one end with a small diameter parallel to the piston and which constitutes the cylinder of a second variable volume pairing with a transfer of the under pressure fluid to this second pairing. The piston of this second pairing is then connected to the cylinder head of the first pairing by a ball type joint or similar device, which makes it possible to have an effective tolerance of the parallelism of the elements and alignment of their axes.

So as to clearly understand the machine of the invention, there now follows a non-restrictive description of examples of two preferred embodiments with reference to the accompanying drawing on which:

Figure 1:
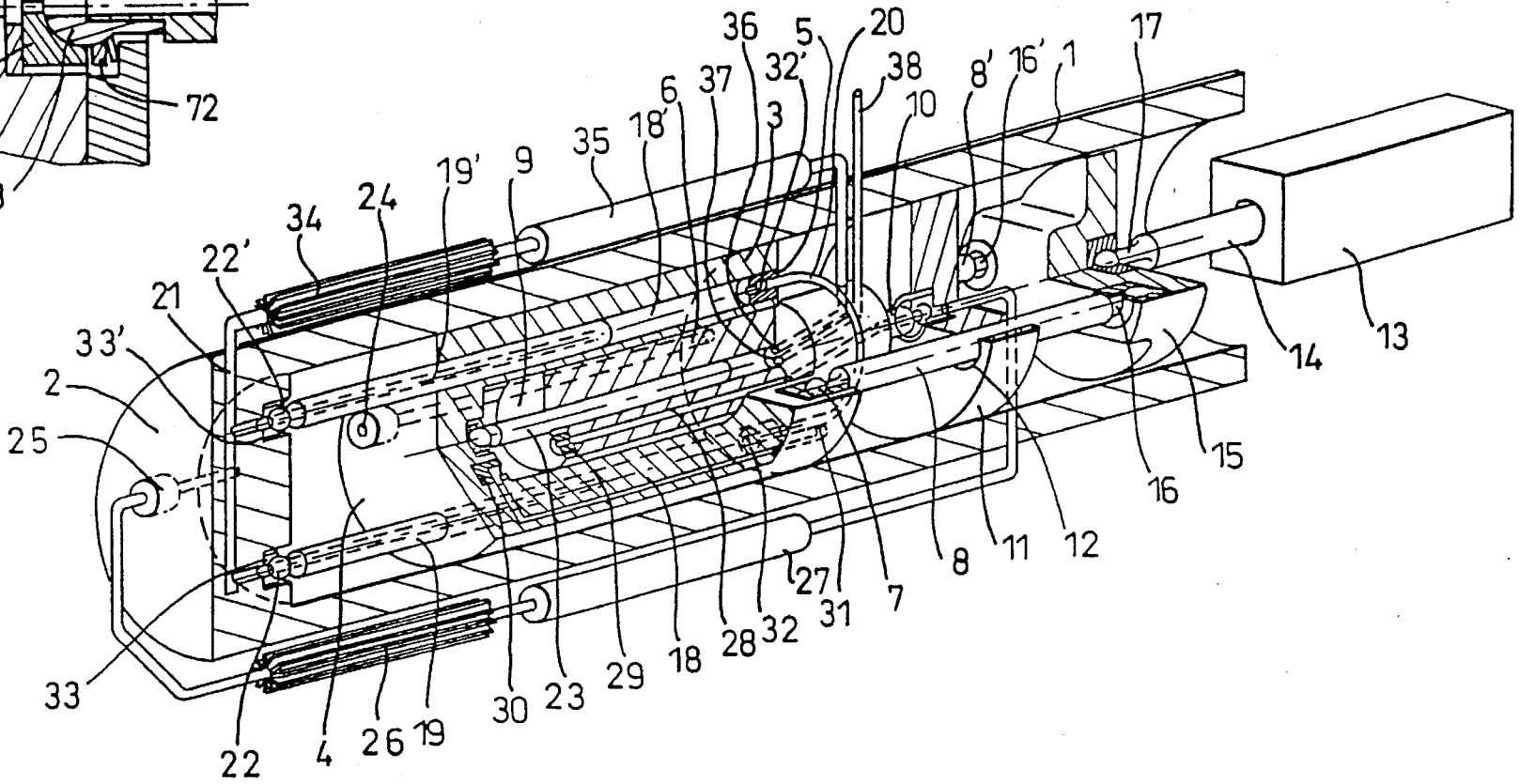
FIG. 1 is a diagrammatic perspective pull up view of a compressor applying the invention.

The compressor shown on FIG. 1 comprises a cylindrical housing 1 imperviously bearing a head 2. The bore of the housing which is shown in sectional form in a plane of symmetry, constitutes a first cylinder in which a first piston 3 moves and which is bored concentrically so as to constitute a second cylinder imperviously bearing a second head 4. The peripheral equipment of the head 4 and the major portion of the piston 34 are adjusted to the same diameter and with extremely slight play in the cylinder 1. The surfaces opposite these elements bear surface treatments or even materials able to allow friction without lubrication.

The end 5 of the piston 3 opposite the second head 4 comprises a gas intake 6 in relation with the inside of the housing 1 and supports two ball type joints 7.

A torn away view for the first piston 3 and the first head 4 makes it possible to see the joint 7, a connecting rod 8 joined to the piston 3 by means of this joint, and a second connecting rod 8' symmetrical to the connecting rod 8 with respect to the axis of the piston 3.

This pull up view also discloses a second piston 9 which cooperates with the bore of the first piston 3 so as to constitute a second compression stage in the same way as the piston 3 and bore of the housing 1 constitute a first compression stage and with the same adjustments and an extremely slight amount of play of the surfaces opposite these element pairings.

The piston 9 is fixed by being held by a joint 10 articulated in a transverse wall 11 of the housing 1. This wall 11 comprises two orifices 12 so as to allow for sliding with play and thus without guiding of the connecting rods 8 and 8'. These rods are driven by a mechanical member 13 which comprises a mobile part 14 having an alternative rectilinear movement and by means of a control column 15 for balancing the forces of the connecting rods, the latter being connected by joints 16 and 16' which are symmetrical with respect to the middle of the control column. This control column is connected by a joint 17 to the mobile part 14. The piston 3 is thus driven in an alternative movement without any radial force with a minimum amount of rubbing and wear in accordance with the aim of the invention.

The piston 3 further comprises two identical symmetrical pipes 18 and 18' with respect to its axis and parallel to the latter and each closed on the side of the end 5. These pipes constitute cylinders receiving the pistons 19 and 19' respectively with extremely slight play adjustments so as to form together a third compression stage. The two variable volume pairings they constitute are connected in parallel by a gas admission circuit 20 and by a flow back circuit 21, the latter being drilled in the head 2. Thus, the variable pressures are identical in each of these volumes, which balances the forces on the piston 3. The pistons 19 and 19' are held on the fixed head 2 by joints 22 and 22' with two degrees of angular freedom and in addition two degrees of transverse freedom, one embodiment example of this being shown on FIG. 2 and which also equips the piston 9 at its retention point on the wall 11 by the joint 10.

Owing to this, the pistons 9, 19 and 19' are aligned in the cylinders opposite them solely via their respective adjustments, their supports on the fixed parts 11 and 2 taking up the position which minimizes the radial forces between the pistons and cylinders, even in the event of a relatively mediocre machining resulting in uncertainty concerning the positions of the joints on these fixed parts.

In addition, a fourth compression stage exists inside the piston 9. To this effect, the head 4 bears at its axis a joint similar to the three preceding joints and which holds a fourth piston 23 with a small diameter and which cooperates with an adjusted cylinder which is constituted by a boring of the fixed piston 9 of the second stage. This piston 23 is thus mobile like the piston 3 and driven by it.

The circuits connecting the four compression stages may appear in various variants. Here, the suction of the first stage is effected via the orifice 6 with a pipe inside the piston 3 so as to feed a suction valve 24 borne by the latter. The compressed gas is removed via a flow back valve 25 and then into a circuit traversing firstly the fixed head 2, then a thermic exchanger 26 and a filter 27 so as to be introduced into a pipe 28 of the fixed piston 9 as far as a suction valve 29 of the second stage. The piston 9 on the figure is shown cut so as to display this pipe and valve, as well as the length of the mobile piston 23.

The flowing back of the second stage traverses a valve 30 borne by the mobile head 4 and then a circuit traversing this head and then the piston 3 so as to rejoin at 31 the feed circuit 20 in parallel with the variable volumes of the third stage with, for each of them, suction valves 32 and 32' housed inside the piston 3 at the bottoms of the cylinders receiving the pistons 19 and 19'.

The flowing back of these variable volumes traverse these fixed pistons 19 and 19' which are drilled over their entire length with preferably small flow back valves at the end of the latter and not shown and possibly safety valves 33 and 33' completing the previous ones at the outlet of the joints 22 and 22' drilled so as to communicate with the flow back circuit 21.

Then the gas traverses a thermic exchanger 34 and a filter 35, is introduced into the fixed piston 9 and into the variable volume of the fourth stage by a suction valve 36 located at the bottom of the bore of this piston. The flow back traverses a contiguous valve 37 and is removed towards use by the pipe 38.

There is also a supplementary thermic exchange between the second and third stages due to the outer mounting of the pipes 20 and 31. Being driven by the alternative movement and in the suction ambience of the first stage, they have a good exchange with this ambience. In addition, small wings may be provided and, if desired, these pipes may be elongated.

Figure 2:
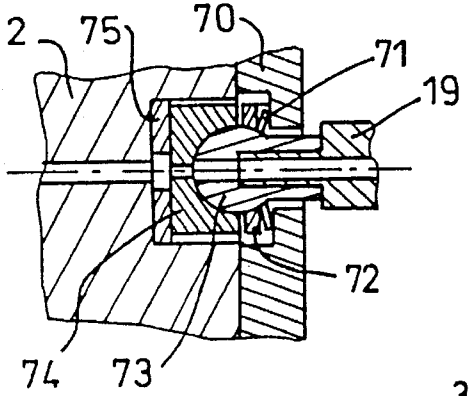
FIG. 2 is a partial cutaway view showing a ball type joint with two degrees of angular freedom and two degrees of transverse freedom used in the compressor of FIG. 1.

FIG. 2 shows a diametrical section of a joint used at the locations 22 and 22' of FIG. 1. The joint is kept between the head 2 and a holding part 70 which is applied against the latter and held in this position by means (not shown), possibly screws, for example. It is constituted by a stacking of parts including:

elastic washers 71 prestressed by the holding part 70, a support element 72 having a flat bearing surface supporting the washer 71 and, on its other face, a spherical bearing, a sphere 73 ended by a cylindrical portion and forcefully stored or welded or glued on the end of the piston 19 and receiving the spherical bearing of the support piece 72, a thrust part 74 receiving the sphere 73 by a spherical bearing, a flat antifriction washer 75 in contact with a flat face of the thrust part 74, this washer, however, being able to be suppressed if the bottom of the head 2 and the thrust part 74 are friction compatible.

The bottom of the head 2 perpendicular to the axis of the piston 19 has a diameter slightly larger than that of the thrust part 74 so that the latter is able to move transversally with two degrees of freedom and thus adjust the axis of the piston 23 with that of the other element of the pairing, that is the pipe 18.

In this example, the various parts are pierced axially so as to constitute a channel for circulation of the pumped fluid, a channel which may lead to a nonreturn valve.

Figure 4:
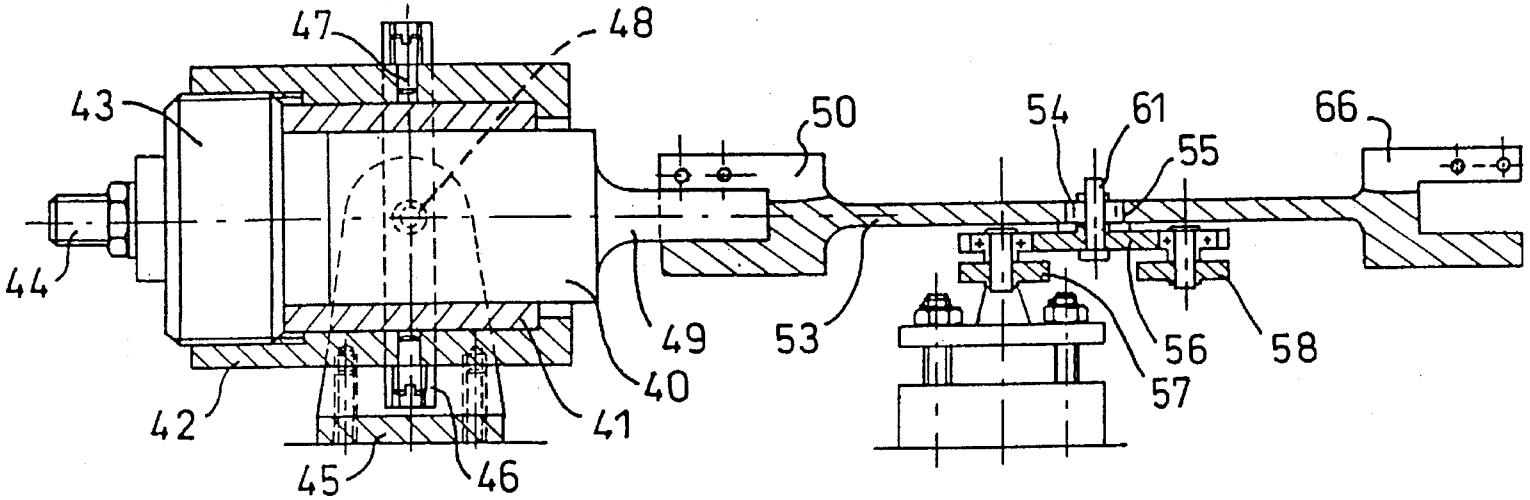
FIG. 4 is a cutaway view along the line IV—IV of FIG. 3.
Figure 3:
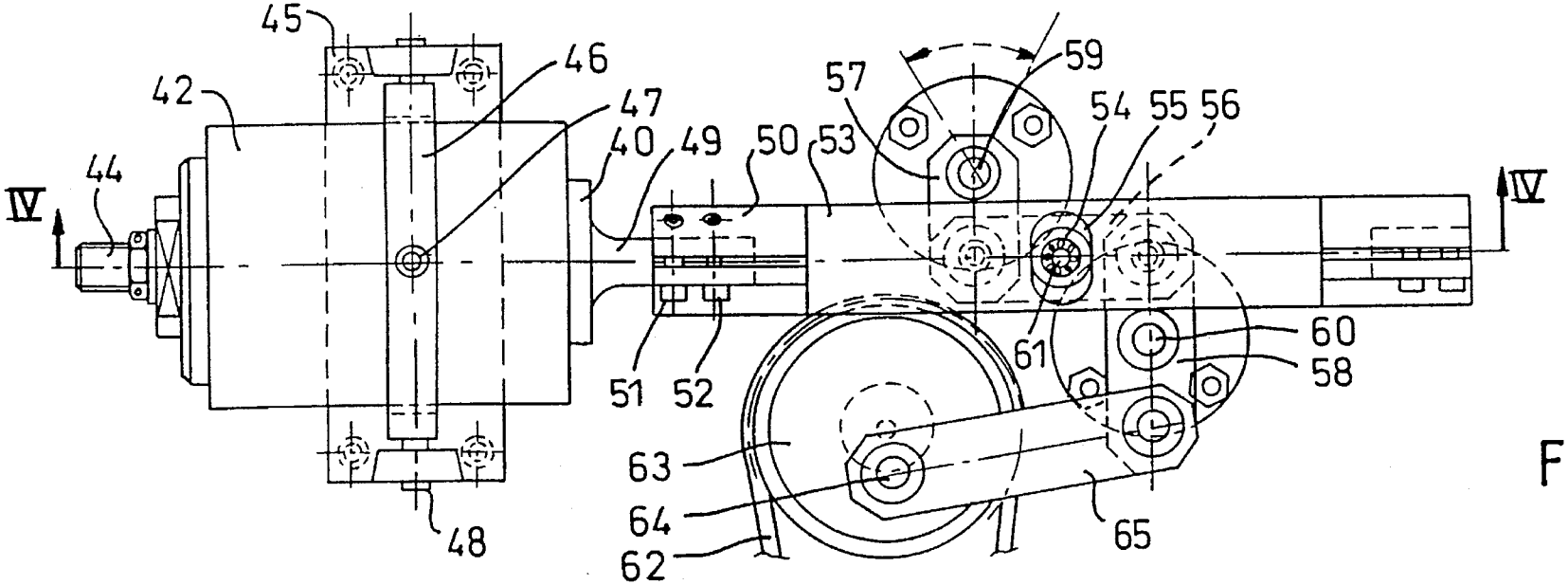
FIG. 3 is a plan view of another piston machine conforming to the invention.

FIGS. 3 and 4 show a machine with a piston 40 which is able to slide with a small amount of play in a cylinder 41 which is kept in a sheath 42 between a shoulder of this sheath and a nut 43. A connector 44 bears the suction and flow back valves (not shown) which may be contiguous like those denoted at 36 and 37 on FIG. 1.

The sheath 42 is suspended in a fixed console 45 by means of a Cardan suspension. This mounting conventionally comprises a mobile ring 46 connected to the sheath by two diametrical bearing journals, such as 47, and to the console by two other diametrical bearing journals, such as 48, in a perpendicular plane. This mounting is equivalent to a joint with two degrees of angular freedom for the cylinder 41.

The piston 40 bears a tail 49 enclosed in a pair of pliers 50 with tightening screws 51 and 52, the pliers constituting an extension of a rod 53. A ball bearing 54 cooperates without any longitudinal play with a hole 55 of the rod 53. This bearing is driven by a known type of Watt rodder formed here of a connecting rod 56 almost parallel to the longitudinal movement, each of its ends being borne by a crank 57 or 58. Each of these cranks is joined by a ball bearing to one of said ends of the connecting rod 56 and by another bearing to a fixed axis 59 or 60, these fixed axes being on both sides of the connecting rod 56 so that the mismatches of the positions of the mobile ends of the cranks relatively to the axis of the rectilinear movement is compensated in the middle of the connecting rod. A dog point 61 at this middle bears the ball bearing 54 which is thus driven by an approximately rectilinear longitudinal movement. This movement interchanges energy with a mechanical member constituted in this instance by a belt 62 connected to a motor (not shown) and which drives a pulley 63 bearing a crank pin moved out of centre 64 so as to activate in alternate oscillation the crank 58 by means of a connecting rod 65 joined to the crank pin 64 and on the extension of the crank 58.

The ball bearing 54 may be mounted without any play in the rod 53 which accurately guides the latter in a rectilinear movement compatible with that of the piston 40 in the cylinder 41, even if there is poor alignment owing to the mounting of the Cardan drive of the cylinder 41.

In one variant, the rod 53 may activate a second piston/cylinder pairing by means of a second pair of pliers 66. In this case, a second Cardan drive mounting supports the second pairing and accurately defines the axis of the alternative rectilinear movement of the two pistons. So as to render it compatible with that of the ball bearing 54, it is then necessary to render the hole 55 oblong in a transverse direction as shown on FIG. 3, or give the four bearing journals of the ring 46 the possibility of moving along their axes which are perpendicular to the alternate rectilinear movement which then provides the cylinder 40/piston 41 with two degrees of freedom of movement perpendicular to this movement.

The description given above has merely been provided by way of non-restrictive example and constructive additions or modifications could be made to it without departing from the context of the invention.

We claim:

1. Machine for exchanging energy between a mechanical member comprising a mobile part having an alternate rectilinear movement and a first piston cooperating with a cylinder for transferring a fluid under pressure, wherein said first piston is connected to said mobile part by means of a first joint and said cylinder is connected to a fixed part by means of a second joint, said first and second joints having two degrees of angular freedom, said first piston being mobile in said fixed cylinder and comprising a bore which cooperates with a fixed second piston, said first mobile piston being driven by two connecting rods which are connected to it by two ball joints and said second fixed piston being connected by a ball joint to a wall fixed to said cylinder.

2. Machine according to claim 1 wherein said connecting rods are connected by two ball joints, through a control column, to a mobile part having a rectilinear movement.

3. Machine according to claim 1 wherein the first mobile piston and the fixed cylinder constitute a transfer stage for fluid under pressure.

4. Machine according to claim 1 wherein several identical pipes are provided in the first mobile piston and are interconnected by circuits, each pipe receiving a piston fixed by a ball joint connected to a head borne by the fixed cylinder.

5. Machine according to claim 1 wherein the fixed piston comprises a bore which cooperates with a mobile piston connected by a ball joint to a head fixed to the first mobile piston.

6. Machine for exchanging energy between a mechanical member comprising a mobile part having an alternate rectilinear movement and a first piston cooperating with a first cylinder for transferring a fluid under pressure, wherein said first cylinder is connected to said mobile part by means of a first joint and said first piston is connected to a fixed part by means of a second joint, said first and second joints having two degrees of angular freedom, a second piston being mobile in a fixed second cylinder and comprising a bore which cooperates with said fixed first piston, the mobile second piston being driven by two connecting rods which are connected to it by two ball joints and the fixed first piston being connected by a ball joint to a wall fixed to said fixed second cylinder.

7. Machine according to claim 6 wherein said connecting rods are connected by two ball joints, through a control column, to a mobile part having a rectilinear movement.

8. Machine according to claim 6 wherein the mobile second piston and the fixed second cylinder constitute a transfer stage for fluid under pressure.

* * * * *